US008882396B2

(12) United States Patent
Occhi

(10) Patent No.: US 8,882,396 B2
(45) Date of Patent: Nov. 11, 2014

(54) METHOD OF CONSOLIDATING FOUNDATION SOILS AND/OR BUILDING SITES

(75) Inventor: Marco Occhi, Parma (IT)

(73) Assignee: Geosec S.R.L., Lemignano di Collecehio (PR) (IT)

( * ) Notice: Subject to any disclaimer, the term of this patent is extended or adjusted under 35 U.S.C. 154(b) by 201 days.

(21) Appl. No.: 13/542,982

(22) Filed: Jul. 6, 2012

(65) Prior Publication Data

US 2013/0011206 A1 Jan. 10, 2013

(30) Foreign Application Priority Data

Jul. 7, 2011 (IT) ..... PD2011A0235

(51) Int. Cl.
*E02D 3/12* (2006.01)
*E02D 1/02* (2006.01)

(52) U.S. Cl.
CPC ... *E02D 3/12* (2013.01); *E02D 1/02* (2013.01)
USPC ..... 405/263

(58) Field of Classification Search
USPC ..... 405/128.1, 263, 266, 267, 270, 302.4; 588/252, 253
See application file for complete search history.

(56) References Cited

U.S. PATENT DOCUMENTS 5,980,446 A * 11/1999 Loomis et al. ..... 588/250

FOREIGN PATENT DOCUMENTS

CA 2583016 A1 9/2008
DE 19521639 A1 5/1996

OTHER PUBLICATIONS

Italian Search Report in ID PD20110235 dated Oct. 11, 2011.
EP Search Report in EP 12172908 dated Sep. 24, 2012.

* cited by examiner

*Primary Examiner* — Tara M. Pinnock
(74) *Attorney, Agent, or Firm* — Kristina Castellano; Castellano PLLC

(57) ABSTRACT

There is described a method of consolidating foundation soils and/or building sites in general, which comprises injections of expanding chemical products which are projected and carried out by means of monitoring the effects which are progressively measured in the soil in the course of treatment by means of sequential tomographies of the electrical resistivity. Those consolidating injections will be carried out until the percentage variation of the electrical resistivity Δρ(%), measured in quasi-real time in the soil being treated and always with respect to the initial condition before the injection will not constitute sequential gradients (Nth) which differ from the preceding one (N−1) for variations contained in the range ±5%.

10 Claims, 5 Drawing Sheets

METHOD OF CONSOLIDATING FOUNDATION SOILS AND/OR BUILDING SITES

CLAIM FOR PRIORITY

This application claims the benefit of priority to Italian patent application PD2011A000235 filed on Jul. 7, 2011, the entire contents of which are incorporated herein by reference.

FIELD

The present invention relates to a method of consolidating foundation soils and/or building sites in general, for example, in order to combat any differential subsidence triggered by natural or anthropic changes to the chemical and physical characteristics of soils which are particularly sensitive to changes in the water content or moisture corresponding thereto.

BACKGROUND

It is known that soils in general are differently sensitive to the variation of their water content or moisture, which variation is particularly attributable to the natural seasonal cycles of the climate which may promote the origins of phenomena of swelling, loosening and leaching of the bases thereof with resultant change in the equilibrium necessary for ensuring in a manner stable over time a sufficient load-bearing capacity thereof to support a building.

The equilibrium mentioned may change differently over time both owing to natural actions such as variations in the conditions of a layer present in the soil involved, mechanical actions of extreme equipment, climatic variations, etcetera, and owing to anthropic actions such as, for example, carrying out digging operations in soils adjacent to the building, vibrations, losses of fluid in the soil. All these actions, which may act on a specific soil, may accentuate or give rise to, for example, occurrences of subsidence and/or subsequent structural collapse of the buildings located above the soil mentioned, produce physical depressions in the soil and the structures in contact with it such as, for example, vertical structures (walls) or horizontal structures (floors) and which can also become evident in soils with temporary and/or periodic good mechanical properties.

These phenomena of impairment technically define occurrences of differential subsidence and are found partially and locally in soils positioned underneath a foundation of a building, causing the foundation subsequently to collapse with resultant settlement.

It is known in the field that, in order to solve those problems of differential subsidence of foundation soils or construction soils, various techniques are currently used in which, in particular, some tend to transfer the loads of the buildings to lithological planes having a greater load-bearing capacity, with these being more or less deep such as, for example, piles, or expanded bodies, in order to increase the overall profile of the structural foundations, so as to reduce the unit load which the buildings place on the soil.

Other techniques, however, are based on the concept of only pursuing an improvement in the load-bearing capacity of the foundation soil via injections of cement-containing products or chemical formulations, which may also expand, such as, for example, injections of cement at high pressure (jet grouting) or injections of polyurethane foams and the like.

Recently, as described in European Patent Application EP0851064, a possible alternative to the highly pressurized injections of cement-containing fluidized admixtures is the injection with free diffusion of expanding chemical products such as low-pressure polyurethane foams which react and become dispersed in the soil so as to create hardened columns of soil mixed with the resin, at established injection locations which are arranged according to a grid-like three-dimensionally regular distribution, carried out without the use of systems capable of verifying effectively the effects thereof in the course of work directly in the soil. That technique uses indirect monitoring means for the structures outside the soil, by means of laser levels and lifting signalling devices which are positioned so as to be fixed to the walls or floors above the soil undergoing treatment. This teaching indirectly stabilizes the production of the consolidation sought, by means of the criterion which combines the result of the increase in the load-bearing capacity of the soil with the lifting of the structures above which has taken place, as also occurs with the patents EP0941388 and EP1314824.

However, European Patent Application EP1536069 describes a different consolidation method, in which injections of expanding polyurethane resins are carried out in accordance with empirical calculation operations carried out in advance of the injections which, being based on the measurement of the difference in electrical resistance between various locations in the soil, which measurement is obtained by means of instrument sensors which are connected to the injection tubes, allow calculation of the moisture level and, consequently, a definition of the quality and the minimum empirical quantity of expanding resin necessary for that consolidation, but without the provision of subsequent tests during and after the treatment operation.

Another method of consolidating the soil, still by means of injections of expanding polyurethane resins, is described in European Patent Application EP2305894. According to this method, there is carried out an injection of two different types of resin, which are formulated with two different nominal densities having a high and low expansion force, respectively, alternating and in accordance with the injection pressure obtained by the resistance offered by the soil, whilst the resin is in a progressive penetration phase.

The Applicant has observed that this type of injection also does not provide any control, in the course of work, of basic geological parameters for the correct achievement of the operation such as, for example, the porosity of the medium investigated, the degree of saturation, the volumetric water content, etcetera, and therefore does not succeed in obtaining a final control of the correct consolidation.

In fact, however, the experience of the Applicant confirms what has already been verified by other specialized applicants (as, for example, in European Patent EP1536069 in paragraphs [0011] to [0019]), and that is to say that the indirect and empirical evaluation of the consolidation of a soil transferred to the sole measure of the principle of lifting of the subsiding structures or the floor above the point of injection, as also taught in patent EP0851064, affords a significant possibility of error because it does not take into account the geological and geotechnical characteristics of the soil and again only in some cases does that lifting correspond to the definitive consolidation of the foundation soil, the term definitive consolidation of the soil being intended to be understood to be such a state of compaction as to ensure stability and support of the structure above over time, and certainly not quantifiable with measurements of the lifting of the building above.

The Applicant further shares the assertion in paragraph [0019] of the patent EP '069, in which the inventor asserts according to his direct experience that localized geotechnical tests may be of assistance only partially in validating the operation and are difficult to repeat in all the locations of the injections, both from an operating viewpoint and from an economic one.

Similarly in the teaching which can be taken from the patent EP1536069, no consideration is given to monitoring the work in the soil and the relevant effect sought for control of the initial project, efforts being limited to a precautionary calculation of the minimum sufficient quantity of resin to be injected on the basis of a measurement of the electrical resistance of the soil. These methodologies of consolidation according to the prior art seek a solution to the problems of settlement by means of quantitative, mechanical and established actions, directed exclusively at seeking significant increases in load-bearing capacity, by bringing about mainly mechanical compressions in the soil without using direct geological controls, in the course of work, of the effects really induced in the volumes of soil treated, by means for monitoring specific geological parameters of the soil and the problem of settlement. Parameters of this type which merit being monitored are, for example, the porosity of the medium, degree of saturation and volumetric water content, etc. As already indicated in the teaching of EP'069 in paragraph [0018], it is demonstrated that good consolidation of the soil has to above all evaluate the presence (or absence) of holes and cavities, the presence and the quantity of water contained in the soil, as well as naturally the geometry of the foundation plane and the resultant depth of the injections. The fact that they are not considered, and the fact of also not considering a control after the improvement effectively achieved in the soil and optional re-projection with final correction, even partial correction, of the initial project, does not make those techniques sufficiently reliable, or they are intervention techniques which do not allow an assumption of which arrangements are necessary for the injection process so as to achieve the consolidation sought, in a manner which is absolutely considered and effective and therefore durable over time.

The disadvantages linked with the techniques of the prior art are then even more accentuated in soils which are clayey, muddy, peaty or composed of mixed fractions thereof; the Applicant verified in practice that, by modifying the hydraulic conditions of those soils, owing to simple mechanical anthropic compression brought about precisely with the expansion of the resin injected with free diffusion in the soil, it is possible to obtain new concentrations and various distributions of water in those treated soils, which are also obtained only after a few kilograms of injected expanding products. Consequently, by applying the known techniques, it is possible to obtain, even rapidly, a false increase in load-bearing capacity of the soil, verifiable outside the soil with the misleading lifting of the structures, as confirmed by the techniques in the prior art. If, however, after the erroneous consolidation, the same treated volumes of soil become subjected to phenomena of cyclical and seasonal drying and re-expansion, owing to natural climatic variations in the medium and short term, the initial problems of subsidence will occur again, or in part, because they are still dependent on an erroneous distribution of the content of water and holes, a consequence of the resins injected in a standardized manner in the soil, for lack of adequate geological control during the work. It is known that a soil in which water has erroneously been confined under pressure by means of injections of expanding resins offers mechanical resistance values, for example, in the penetrometer vertical test (1D), which sometimes appear to be satisfactory upon immediate observation, but which result in fact in a non-definitive misleading mechanical result, since it is influenced by interstitial over-pressures of water which are erroneously obtained in the soil.

Only afterwards, when the interstitial water content contained in the soil becomes slowly diluted, naturally becoming dispersed according to time and methods mainly as a function of the type of lithology, granulometry and the ambient climatic conditions, will it be possible to establish the recurrence of the original differential occurrences of subsidence. This limit is almost confirmed by all the techniques set out above which become evident, in the criterion validating the consolidation, by the control of the start of the geometric lifting of the treated soil.

The Applicant has recently proposed a methodology for intervention in European Patent Application No. EP1914350, setting out a consolidation method in which there is provided the control of the injections during work by means of the 3D tomography of electrical resistivity of the soil being treated. As published in Engineering Geology 119 (2011) by G. Santarato et al. in the article "Three-dimensional Electrical Resistivity Tomography to control the injection of expanding resins for the treatment and stabilization of foundation soils", page 18 ff., there has been carried out and developed a method which brings about correct and effective consolidation of the subsided soil, by carrying out expanding injections in a considered manner, owing to the results progressively obtained by the 3D tomography of the electrical resistivity, in which, during work, with the geoelectrical monitoring always being maintained in operation, it becomes necessary to modify, as necessary, the parameters of injection in accordance with the effects sequentially encountered in the soil and in such a manner as to make uniform the chemico-physical characteristics of the subsided volume with those of adjacent volumes of soil which have not subsided and which are taken as a reference.

It is known that, based on the measurement of the electrical resistivity via the application of the formula of Archie, in which, in first approximation, the resistivity of the soil is directly proportional to the following parameters of the soil:

$$r_m = aS^{-n}p^{-m}r_w$$

where:

$r_m$ resistivity of the soil, a, m, n empirical constants,

S degree of saturation, p porosity of the medium, and $r_w$ resistivity of the fluid in the porous medium, it is possible to determine the porosity of the medium being investigated, the degree of saturation and the volumetric water content (Kalinski and Kelly, 1993), all geological parameters which are of fundamental importance both in terms of the preliminary evaluation of the causes of the subsidence and subsequently of the effects of improvement which follow the consolidation by means of injections of expanding admixtures.

Although this last teaching solved the problem of geological control, during work, of the effects in the soil caused by the injections of resin, by means of the sequential measurement in quasi-real time of the electrical resistivity, sometimes suffers from the limitation that it is not always possible to conveniently provide for an adjacent volume of soil which has not subsided and which, owing to chemico-physical and structural characteristics, can be taken as a reference in the subsequent stabilization and homogenization process of the subsided volume of soil.

SUMMARY

An object of the present invention is to define a consolidation method for soils which overcomes the limitations of the prior art, by modifying during the treatment of the soil, by means of injection of expanding resins, the main parameters of the operation relating to the injection (geometric elevations of injection, quantity and sequence of the injection cycles, characteristics of the expanding resin, etc.) based on the control during work of the electrical resistivity ρ, brought about by means of tomography of the electrical resistivity ρ (measured in Ωm). In particular, the effects brought about by sequential and considered injections of expanding admixtures into the volumes of soil subjected to subsidence are recognized by means of measurements over time of the percentage variation of the electrical resistivity Δρ(%) as set out in detail below.

The method of the invention provides for, as the first step, carrying out a measurement of the initial electrical resistivity, referred to as $\rho_0$, in predetermined volumes of the soil which it is desirable to consolidate in order to have a general view of the initial situation of the soil. The measurements of resistivity can be carried out with multi-electrodes supported at the surface or in holes in the soil provided to receive the electrodes even at greater depth.

Merely by way of example, the instrumental equipment for carrying out that measurement of electrical resistivity comprises a multi-electrode georesistivity meter which is provided with automatic control of the electrodes and is thus capable of switching the electrodes which are advantageously positioned in input electrodes (locations of energization of the soil) and in measurement electrodes with all possible quadripolar combinations, so that the automatic reconstruction of the data in matrix form allows immediate processing with the finite elements in order to obtain an intuitive image of the distribution of the electrical resistivity in the soil being investigated. However, other pieces of equipment may be used.

The values of electrical resistivity obtained by means of the suitable equipment can then be locally correlated to the density and therefore to the compactness of the soil as described below.

The successive measurements of the electrical resistivity are carried out preferably in the same volumes in which the initial resistivity is measured.

Therefore, there is/are carried out one or more injections in one or more locations of the soil which it is desirable to consolidate with one or more expanding resins, where the term expanding resin is intended to refer to a resin including an expanding agent. For example, such a resin includes a bicomponent admixture preferably of the type of a closed-cell polyurethane. The locations in which the injection of the resin is carried out may all be at the same level (that is to say, at the same depth of soil) or at different depths in the soil. Furthermore, as the first general injection, there can first be carried out injections in some locations of the soil and then in other locations of the soil, or it is not necessary for the first injection in all the designated locations to occur at the same time.

Since, as mentioned, the measurements of electrical resistivity are preferably processed by means of a process of inversion by means of dedicated mathematical algorithms, in order to create a three-dimensional graphical representation (3D tomography) thereof according to a preferred embodiment, the electrodes are positioned on and/or in the soil in accordance with the necessary depth of investigation because the geoelectrical monitoring has to be able to cover both the foundation structure and the volume of soil which supports the construction as, for example, published by the Applicant in EEGS Sageep (2007) by F. Fischanger et al. in the article "Monitoring resins injection with 3D electrical resistivity tomografy (ERT) using surface and multiborehole electrodes arrays", page 1228 in the case of electrodes positioned at the surface.

Generally, the spacing between the measurement locations of the electrical resistivity is then equal to half of the spacing of the electrodes which, owing to geoelectrical properties at the surface, may vary from a minimum of 0.50 m to a maximum of 5 m whilst, owing to geoelectrical properties in the hole, it may vary from a minimum of 0.20 m to a maximum of 2 m, given that the depth of investigation is in accordance with the inter-electrode spacing. Furthermore, as anticipated, the volume of geoelectrical investigation depends on the dimensions of the soil which it is desirable to consolidate within the so-called "significant volume" of the foundation soil under the building. A significant volume has a form and extension different in accordance with the problem of consolidation and is individual from case to case. Preferably, therefore, in the method according to the invention the electrical resistivity is measured in such a significant volume.

Similarly, the injections are carried out in a plurality of locations so as to cover the significant volume involved in the subsidence or which needs reinforcement. The exact positioning depends—inter alia—on the electrical tomography image preceding the injections, which is carried out by processing the measurements of initial electrical resistivity $\rho_0$, and which therefore allows establishment of the volumes of the soil within the significant volume which most needs consolidation. The duration of each injection is variable in accordance with the type of soil and the quantity and the type of resin used.

As an additional step, therefore, there is again monitored, preferably both during and after the injection(s) mentioned, the value of the electrical resistivity in the same volumes set out above at which the initial resistivity was measured and similarly there is preferably processed an image which defines the distribution of the electrical resistivity in the soil being investigated. Once the first injection step has been carried out, and the measurement of resistivity before and after it, those steps, that is, the steps of measuring the resistivity, processing the image of distribution of the electrical resistivity and subsequently injection of resin, are repeated until the values of the resistivity in the volumes involved remain substantially stable, as set out in greater detail below.

The term "injection" is intended to identify the introduction of expanding resin in a predetermined volume of the soil and at an established depth (which may also be at the surface). The duration of an injection, that is to say, the time between the start of the introduction of resin in the soil and the interruption thereof, is variable and established in accordance with the soil and the quantity of resin which it is desirable to introduce in a single injection. It is also possible to consider a single injection at a single location, or for a given location of the soil there is carried out a single injection (and not a plurality thereof at different intervals) whose parameters may be modified, and it is interrupted when the electrical resistivity becomes stable, as set out below.

The Applicant has been able to verify that the variations of electrical resistivity, which are obtained in the soil during the consolidation, are representative of the geometric distribution of the "effects" following the injections, where the term "effects" is intended to refer to, for example, the filling of cavities, the reduction of holes and/or the removal of interstitial water in the treated soil, and the like. The effects described above contribute, as already mentioned, effectively to a better density/compaction of the foundation soil and therefore to the final consolidation thereof.

In order to make it clearer that a very relevant parameter in the consolidation of a soil is the variation over time of the electrical resistivity of the soil, initial reference is made to FIG. 1 (A, B, and C). In those Figures, it is possible to see the tomography images of the electrical resistivity corresponding to the state of the soil before (image on left) and after (image in centre) an injection of resin, carried out at the depth $Z_{in}$=−1.50 meters from the plane of the land in clayey soil saturated with fresh water positioned above a non-saturated seam which is more resistive. In particular, for this example, it can be seen how the injection of expanding resin has brought about two obvious effects. The first is the fact of having urged downwards (location of less energy) part of the interstitial water present in the saturated cohesive soil before the injection, whilst the second is the fact of having brought about mechanical compressions in an upward direction by reducing the holes of the non-saturated cohesive matrix, in part because they are filled with resin and in part owing to the effect of mechanical compression of the soil surrounding the injection. The right-hand image illustrates, however, the percentage variations of resistivity obtained after the injection. As may be observed, the soil under the injection has received additional fresh water so that the resistivity thereof is completely reduced (negative percentage variation—blue colour), whilst the soil above the injection has increased the resistivity thereof (positive percentage variation—red colour) having reduced the initial porosity thereof owing to the filaments of resin and the mechanical action of compression owing to the chemical expansion of the injected material. With the monitoring always being kept operative during the intervention, it is therefore advantageously possible to adjust the injections according to the responses of the soil in accordance with the best consolidation possible.

Reading the electrical tomography images of FIG. 1A, FIG. 1B, and FIG. 1C may be assisted by the data taken from the scientific literature available which is today capable of setting out with absolute reliability the parameters of resistivity of rocks, minerals, metals and materials.

Below are the parameters of resistivity for some of the most common media widely contributed by the scientific community in literature:

| Lithotype | Resistivity (Ωm) |
|---|---|
| Fresh water | 10-100 |
| Sea water | <0.2-0.3 |
| Pure water | 100-1000 |
| Natural water | 1-100 |
| Water with 20% of salt (NaCl) | 0.001 |
| Loose dry sands | ~1000 |
| Loose sands saturated in fresh water | 80-150 |
| Muds saturated in fresh water | 15-50 |
| Clays saturated in fresh water | 5-20 |
| Gravel | 100-5000 |
| Dry gravels | >1000 |
| Gravels saturated in fresh water | 150-300 |
| Sandstone | $100\text{-}10^4$ |
| Limestone | 100-5000 |

As the available scientific literature confirms, it is possible to determine the density of the consolidated medium and therefore the intensity of compaction of a soil owing to measurements of electrical resistivity as set out in the article: S. Seladj I et al., 2010. The effect of compaction on soil electrical resistivity: a laboratory investigation. European Journal of Soil Science.

Other studies confirm, however, the existence of local empirical correlations between the electrical resistivity and the measurement of cone point resistance obtained with a penetrometer, as demonstrated, for example, by: Bernard U. M., Dudoignon P., Pons Y., 2009, Characterization of Structural Profiles in Clay-Rich Marsh Soils by Cone Resistance and Resistivity Measurements. SSSAJ: Volume 73: Number 1, January-February, doi:10.2136/sssaj2007.0347, as illustrated, for example, in FIG. 2 or as set out in the article: Jean-Christophe Gourry, Robert Wyns, François Lebert (1997): "Cartographie prédictive des propriétés mécaniques des altéritespar mesure de la résistivité électrique en continu", Geofcan, Gèophysique des sols et des formations superficielles, pages 128-131. Therefore, there may be defined in specific terms a satisfactory local correlation, at least an empirical qualitative correlation, between the tomography of the electrical resistivity of the soil and the density/compactness thereof.

In addition to this local empirical correlation demonstrated above, another study of the Applicant, conducted on a number of injection operations carried out on cohesive soils, initially allowed confirmation of the existence of the local empirical correlation for each site between the resistivity and the measurements of cone point resistance as well as a directly proportional correlation between the percentage variation of electrical resistivity and the percentage variation of point resistance, where these last measurements have been obtained with a dynamic penetrometer of the type DPM 30 inside a cylindrical volume of soil (radius r=1 meter), whose axis of symmetry was coincident with the vertical axis of injection. That is to say that it can be seen that a positive variation of the electrical resistivity owing to the injection of resin is correlated with a positive variation over the same time of the compactness of the soil, and vice versa. The term positive variation is intended to be understood to be an improvement in the state of compaction of the soil (reduction of the holes and the water).

Merely by way of example, in order to illustrate a possible local correlation between the values of electrical resistivity and the point-penetration resistance, FIG. 5 illustrates a 2D hologram of the electrical resistivity in the significant volume under the foundations of a building (image on left) and classification chart for the static penetrometer (Schmertmann 1978) which sets out a local correlation of the values of resistivity and point-resistance of the same soil (image on right), the reason for which, once the specific local correlation of the site has been defined, is that it is economically more advantageous to be able to determine rapidly the resistance of the soil starting from the results of the ERT and without having to carry out a great number of penetrometer tests in situ for each vertical being examined, as confirmed, for example, by: Kumari S. et al. Soil characterization using electrical resistivity tomography and geotechnical investigations. Journal of applied Geophysics 67 (2009) 74-79.

According to the consolidation method of the invention, therefore, the initial step of taking the measurements of resistivity at various locations of the soil and the subsequent processing of the measurements with the finite elements initially allows correct identification by way of an image, with ease of intuition, of the main characteristics of the weak portions of soil owing to recordal by tomography of the preliminary electrical resistivity which, as seen above, may be linked to the initial "status" of the soil before the injections (Ayolabi A. et al. Constraining causes of structural failure using electrical resistivity tomography (ERT): a case study of Lagos, Southwestern Nigeria. ΟΡΥΚΤΟΣ ΠΛΟΥΤΟΣ /MINERAL WEALTH 156/2010).

In the subsequent step, however, there is injected into one or more advantageously selected locations of the soil to be consolidated the expanding resin (or resins) and, during that injection and/or after it, there is monitored, with suitable systems for geoelectrical measurement at the surface or in holes, the effect of the chemico-physical action obtained by means of the admixtures injected, in particular the resistivity of the soil is monitored, preferably by means of 3D Electrical Resistivity Tomography (ERT). In this manner, for example, it is preferably possible to "see" with virtual images in quasi-real time, obtained via the measurement of the percentage variation of the electrical resistivity, what occurs during the treatment (Santarato et al., 2011).

For each volume of the soil established (or for a single volume in the case of a single injection), in which this volume is always a portion of the above-defined significant volume, as mentioned there is carried out an injection which lasts a specific period of time. At the end thereof, in accordance with the results of the measurement of the electrical resistivity, and in particular the variation thereof as set out more clearly below, a subsequent injection of expanding resin is or is not carried out in the same volume of soil which is potentially affected by the effects of the expansion of the resin. The characteristics of the second injection, for example, for the duration and quantity of resin introduced or for the type of resin introduced, may be equal or substantially different from the characteristics of the first, and so on for any subsequent injections. In greater detail, the various injections are continued in the manner described above until the sequential differences between the last condition reaches in the N-th injection $\Delta\rho_N$ in the soil during the treatment with respect to the one previously measured, that is to say, in the injection N−1 $\Delta\rho_{N-1}$ will not form a gradient which has values between ±5%. As an alternative to differentiating between a final injection N and the preceding one N−1, it is possible to consider for each volume a single injection which continues for time t and therefore in the same manner the injections are interrupted when the sequential differences between the last condition reached $\Delta\rho_N$ in the soil at a specific t-th period of time with respect to the one previously measured $\Delta\rho_{N-1}$ at the preceding (N−1)th time do not form a gradient which has values between ±5%.

The practice of building sites acquired in the course of those years and the experiments carried out on test sites have allowed it to be demonstrated that the significant volume of soil subjected to treatment with injection of resins has electrical behaviour which tends towards an asymptotic value of resistivity in accordance with the condition of treatment carried out. FIG. 6 illustrates what has been set out above: in the course of the intermediate stages of injection, the electrical resistivity of the significant volume tends to become stabilized towards a limit value.

The gradient of the electrical resistivity in the course of the injections (or, if it is preferred, over time) is therefore a parameter capable of monitoring the state of completeness of the treatment. In particular, in order to define a criterion for stopping the injection operation, the Applicant has seen that a better choice is to use the following function F(N), which may, for example, be calculated for the measurements ERT obtained in accordance with each intermediate injection stage N or at intervals of time N over the same injection.

According to the method of the invention, the injections in a predetermined volume of soil, that is to say, the injections of resin in the soil, are finished when:

$$F(N) = \left|\left(\frac{\rho_N - \rho_0}{\rho_0} - \frac{\rho_{N-1} - \rho_0}{\rho_0}\right)\cdot 100(\%)\right| = \qquad \text{formula (1)}$$

-continued $$= \left|\frac{\rho_{N-1}}{\rho_0}\cdot\left(\frac{\rho_N}{\rho_{N-1}} - 1\right)\cdot 100(\%)\right| \leq 5\%$$

where:

N represents the different stages of injection of resin in the soil or the N-th period of time with: N whole=1, . . . n.

Hereinafter, the value of resistivity in a specific volume defines the value of mean resistivity in a volume which is below the soil to be consolidated, that is to say, preferably mean resistivity=the value of mean resistivity of the volume identified as the portion of the significant volume of soil.

$\rho_0$ is the measurement of mean electrical resistivity (Ohmm) in a specific volume of the soil, carried out before the injections of resin, and referred to for the sake of brevity as "white measurement".

$\rho_1$ is the first measurement of mean electrical resistivity of the same volume of soil in which the white measurement is carried out, and it is carried out at the first injection stage or alternatively at the first period of time of measurement $T_1$, referred to for the sake of brevity as "first intermediate measurement".

$\rho_{N-1}$ is the measurement of mean electrical resistivity in the same volume of soil in which the white measurement is carried out, and it is carried out at the N−1 injection stage, or similarly at the time $T_{N-1}$, referred to for the sake of brevity as "intermediate measurement N−1".

$\rho_N$ is the n-th measurement of mean electrical resistivity still at the same volume of soil in which there were carried out the white measurement and first intermediate measurement, at the end of the injections or better after the intermediate stage N or the time $T_N$, and for the sake of brevity referred to as "black measurement".

$$\left[\left(\frac{\rho_N - \rho_0}{\rho_0}\right)\cdot 100(\%)\right] = \Delta\rho_N$$

is the percentage variation of resistivity between the last measurement N and the one preceding the injections.

$$\left[\left(\frac{\rho_{N-1} - \rho_0}{\rho_0}\right)\cdot 100(\%)\right] = \Delta\rho_{N-1}$$

is the percentage variation of resistivity between the penultimate measurement N−1 and the preceding one N−1 (or at the time N and N−1).

$$\frac{\rho_{N-1}}{\rho_0}$$

is defined as the "factor of sensitivity" of the initial model which takes into account the type of soil (clay, mud, sand, etc.).

Hereinafter, therefore, the "state N" serves to indicate either the state following the Nth injection, or the state following the Nth period of time $T_N$ of measurement. This is because the injections in a specific volume of soil may be a plurality of injections separated in time, that is to say, it is possible to establish a start and an end of each injection, that is to say, there is a single injection which continues over time and the time is subdivided into constant periods and, as each period passes the subsequent state of the injection starts.

The control parameter F(N) under discussion is capable of taking into account together the "absolute" increase in resistivity with respect to the "white" condition (first factor of Eq. 1) and the "relative" increase of the same parameter of the intermediate stage N with respect to the intermediate stage immediately preceding it (second factor). The function further also allows the inclusion in the evaluation at the end of the operation of the type of soils in which work is being carried out, in accordance with the dependency on the parameter $\rho_0$, "basic resistivity" specific to the geolithological context being examined.

This geological control, based on the comparison of the continuous percentage variations of the electrical resistivity obtained sequentially for each stage of the injections, between the last measurement carried out and the one in the stage which occurred previously, or at a specific time and the measurement carried out at the previous time, allows it to be established when the soil involved in that treatment no longer needs additional injections, because it has reached its maximum level of improvement/consolidation possible. According to the Applicant, by means of the tests and the studies prepared by him, there is no longer any need for injections when, as mentioned, $$\left|\frac{\rho_{N-1}}{\rho_0}\cdot\left(\frac{\rho_N}{\rho_{N-1}}-1\right)\cdot 100(\%)\right| \leq 5\%:$$

the Applicant has been able to observe that any subsequent injections, when it is within the range of formula (1), for additional quantities of resin, would not provide additional significant and proportional improvements to the last condition achieved.

Preferably, in order to avoid "false positives", the injections are not terminated at the first time at which the validity of Eq. (1) is verified, or at the first time at which |F(N)| falls below a value of 5%, but instead the measurement is repeated a plurality of times, for example, ¾ times, during which it is possible to carry out another injection.

The object of the method of the invention is to seek a reduction or removal of occurrences of differential subsidence of the soil owing to its correct consolidation: the Applicant has found that it is advantageously and economically possible to intervene without having to hypothesize beforehand quantities of expanding resin to be injected, therefore preventing estimates and/or the introduction of pre-estimated quantities, which are generic and probably insufficient, or overdimensioned for the real requirements of that soil and it is possible to avoid carrying out a great number of penetrometer tests in situ. When the sequential difference between the percentage variation of resistivity measured in the soil in the course of work in the last condition achieved and the one which occurred previously tends to settle in a range of values between ±5%, it will no longer be necessary to inject additional eco-resin and the consolidation of that soil is at an end.

Naturally, additional injections will not be carried out in that specific volume, but, in the other volumes in which the injections have been carried out, they can continue if therein the function F(N) is not within the range of formula (1). Therefore, during the treatment of all the significant volume, there can be some portions in which the injections are stopped because the condition of Eq. (1) is satisfied after a short time or after a few injections, and other portions in which the injections continue for a greater time or are more numerous.

Therefore, there can be carried out in the soil a single injection in a plurality of volumes belonging to the significant volume and the electrical resistivity can be monitored at intervals of time T. If, at a specific location, the mean resistivity of the soil, in particular preferably all the significant volume, is such that, between two separate periods of time or two separate successive injections, the equation (1) is verified, then the injection step is interrupted. Alternatively, an injection is carried out in a plurality of locations in the soil to be consolidated. Again, successive injections may continue only for some of the volumes treated initially. The injection is terminated and the measurement of resistivity is carried out. A new injection into the plurality of volumes is carried out, and the process continues N times for a plurality of injections N (N injections for each volume selected). In that case, for each volume the injections are also ended when Eq. (1) is satisfied.

An objective of the invention is to increase the field of application of the technique of consolidation of soils, also providing, in the absence of conditions of valid comparison to be taken as a reference in the process of chemico-physical homogenization of the soil which has subsided, for volumes which have not subsided.

Another advantage, according to the invention described herein, is making the consolidation operation more economical and more considered by being able to achieve the final condition required and/or maximum improvement possible in the volume of soil subjected to subsidence, with the quantity of injection admixture effectively necessary, owing to the continuous measurement of the course of the percentage variation of resistivity which allows it to be established when to interrupt the treatment, that is to say, when the gradient between the last percentage variation of resistivity and the one which occurred previously settles at values between ±5% and therefore indicating that additional injections in that volume will not produce significant improvements over what has already been obtained.

Additional features, advantages, and embodiments of the disclosure may be set forth or apparent from consideration of the application including the summary and following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The following examples illustrate the characteristics and advantages of the invention, described in greater detail by way of non-limiting example with reference to the appended drawings, in which.

DETAILED DESCRIPTION

Figure 4:
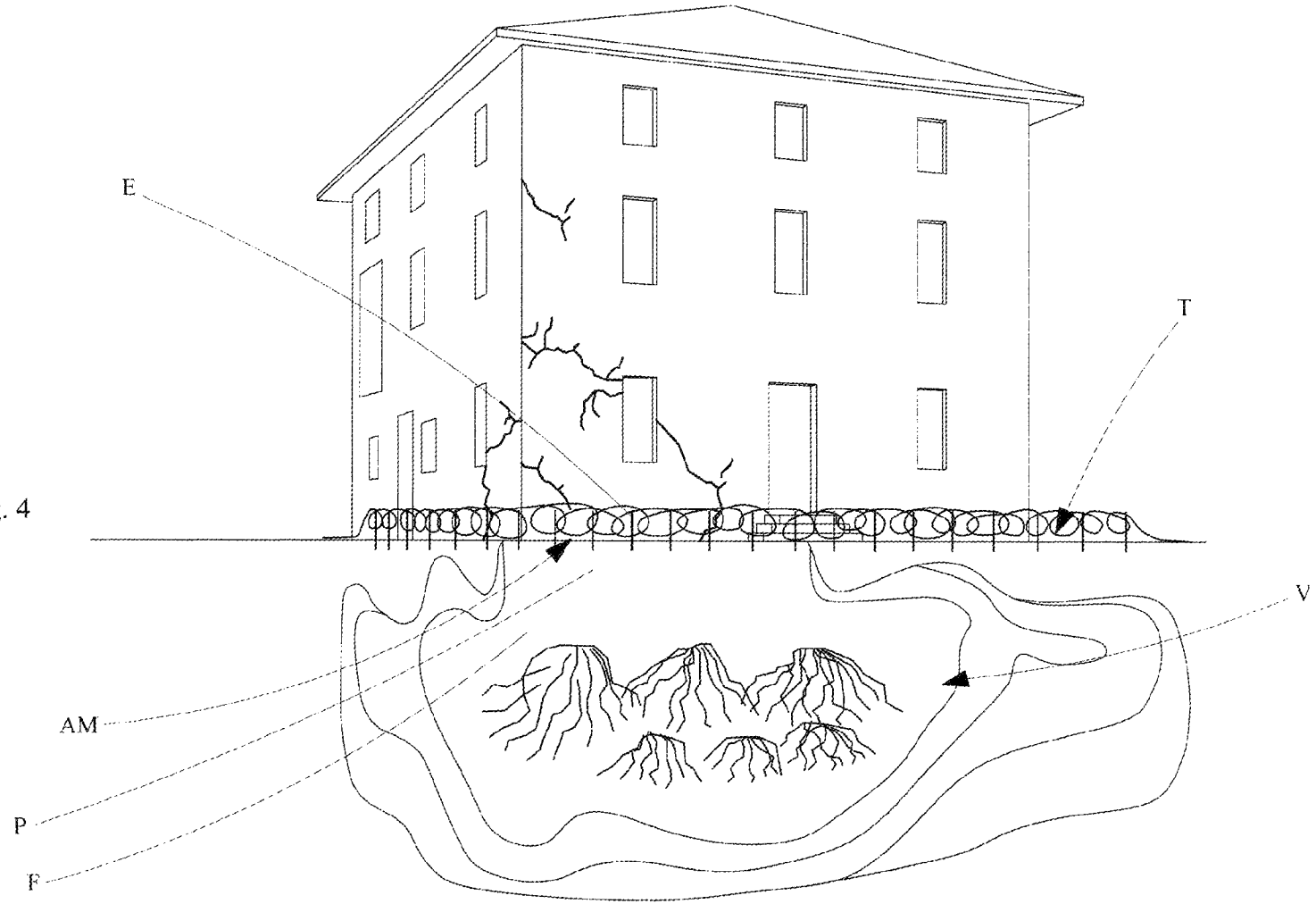
FIG. 4 is a diagram of a device operating according to the method of the present invention.
Figure 5:
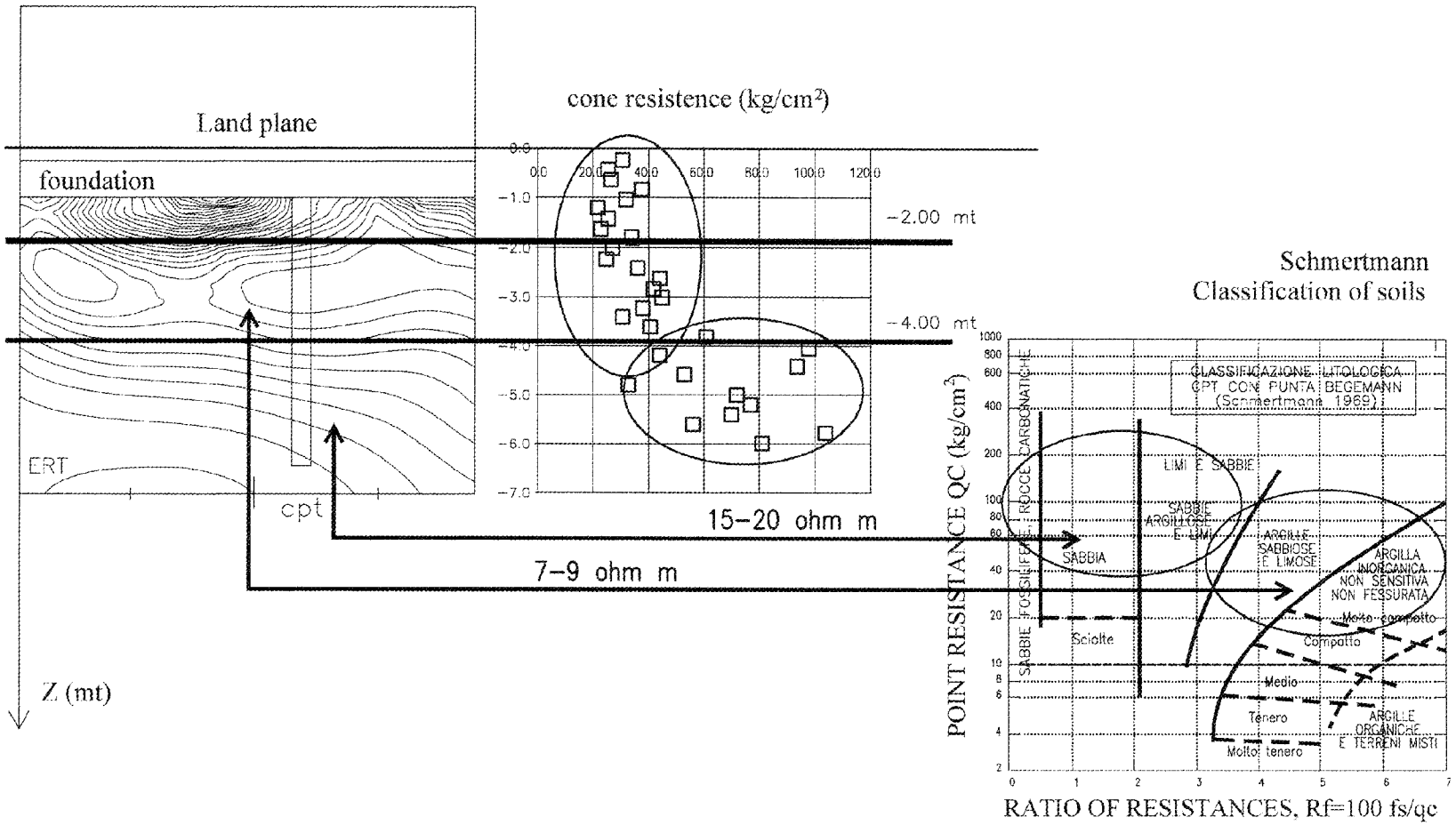
FIG. 5 shows a hologram of the electrical resistivity in the significant volume and classification chart for the static penetrometer (Schmertmann 1978) which measures a local correlation of the values of resistivity and point resistance.
Figure 6:
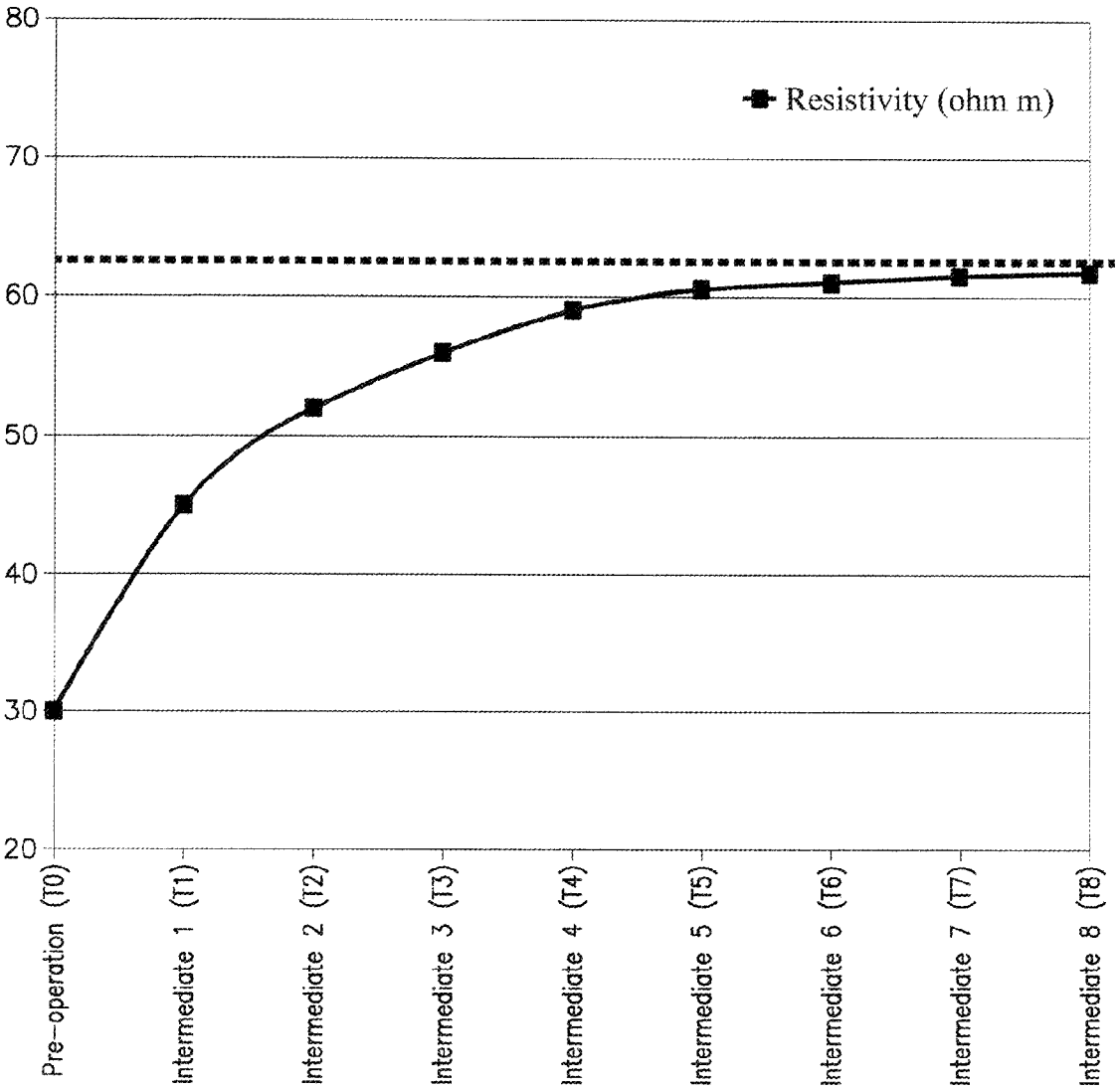
FIG. 6 is an example of a graph of the variation of the electrical resistivity in the treated soil with variation of the intermediate stages of injection.

With initial reference to FIG. 4, in the soil to be consolidated as the first step according to the method of the invention, generally referred to as T, there is provided a measurement device AM in order to monitor the electrical resistivity of the soil in the predetermined volumes P thereof (at least one volume), before, after and preferably during the injections of expanding material.

The expanding material, or an expanding resin, is the material preselected to consolidate the soil and is injected therein according to a known technique which is conventional in the field. In particular, the expanding resin is injected into the soil by means of suitable holes F which are provided at predetermined distances from each other. The resistivity is monitored within a significant volume V of the soil which it is desirable to consolidate, for example, under a foundation. The various single volumes are therefore portions of the significant volume.

Preferably, a type of resin used is a closed-cell polyurethane resin, both mono or multi-component, preferably having an expanding force greater than a minimum of 20 kpa and rate of reaction greater than a minimum of 15 seconds from the mixing of the product and under ambient temperature conditions of 25° C.

For example, the measurement device of the electrical resistivity is a device for carrying out 3D tomography of electrical resistivity and includes electrodes E at the surface and/or in examination holes through the reference layer. The electrodes E are connected, for example, to a multi-channel georesistivity meter which allows a series of quadripolar measurements (AB;MN) to be carried out by means of a progressive energization of an electrode pair (AB) and the resultant electrical potential to be determined at other pairs of poles (MN). The monitoring electrodes E are provided according to considered geometric configurations, in the region of the portions of soil to be consolidated.

The electrodes, which are distributed at the surface or vertically at depth, are preferably arranged with constant spacing which is sufficient to ensure a correct coverage of all the soil being examined and which must contain the significant volume. According to a preferred example of the method of the invention, the electrodes E are positioned on the soil, remote, separated and spaced apart from the holes F which are intended for the injection tubes of the expanding resins in accordance with the desired precision and the geometrical extent being investigated.

The measurements of resistivity are interpreted and processed in a suitable manner, including by means of methods and techniques which are known in the art. For example, the processing of the data progressively monitored is carried out by means of an electronic processor PC which is provided with processing software for the finite elements. An example of such software which is commercially available is a "customized" piece of software developed by GeostudiAstier s.r.l. (Livorno, Italia) on the basis of the software in collaboration with the Americana ERTLab™ which is a 3D software for inversion of resistivity and induced polarization which represents an instrument for interpreting geoelectrical measurements. Owing to a modelling algorithm using the hexahedral Finite Elements, ERTLab is able to invert measurements which are acquired in contexts with complex topography. A group of inversion routines allows a robust and reliable interpretation of the land measurements, even in the presence of substantial levels of noise.

The graphic environment of the software then allows a display of the results of the inversion by means of a complete series of graphic objects (sections, iso-resistive surfaces, volumes, etc.).

There is further provided a system for injection of the expanding resins. The injection system(s) can be provided on self-propelled means.

The software has been modified suitably for the Applicant with suitable routines capable of studying the electrical resistivity and in particular also receiving data of point-penetration resistance for the definition of the specific correlation of the site with the tomography of electrical resistivity.

The PC for processing the data may be both positioned in the region of the soil to be consolidated, or remotely connected to the georesistivity meter, for example, by means of a wireless connection, preferably an internet connection.

In a second step of the method of the invention, therefore, the device AP described above for the measurement of the electrical resistivity of the soil T to be consolidated carries out a first measurement thereof, for example, by means of monitoring before the injection. That measurement of the initial situation allows, by processing with mathematical algorithms simulating the data of electrical resistivity acquired, a tomography of the electrical resistivity to be obtained representative of the soil being investigated, owing to which it becomes possible to project in a considered manner the injections of expanding material. In particular, preferably what is projected is the number, the horizontal elevations (x,y) and vertical elevations (z) of the injection locations in the soil, the parameters of injection of the system, the type and characteristics of the products or the admixtures to be injected. All this can be obtained by means of the tomography of the initial electrical resistivity.

There is further optionally carried out a penetrometric test before the injections for calibrating the geoelectric model of the site or for defining the local correlation of the site between the values of resistivity and those of mechanical resistance.

Therefore, with all the characteristics of the holes in the soil being established, as the third step of the method of the invention, those holes are produced in the soil, directed towards or positioned directly in the volumes of soil to be consolidated, in accordance with the anomalies measured such as, for example: cavities present, abnormal concentrations of interstitial water, excessively porous and poorly compacted volumes of soil, etc.

The injection is carried out according to the prior art and, for example, injector tubes are preferably inserted in the above-mentioned holes F.

According to another step of the method of the invention, the first step of the injection is therefore carried out. It is possible, as the first step of the injection, both to carry out a single injection in a single hole, and a plurality of injections in the sense of one injection for each of a plurality of holes, and a plurality of successive injections for each of a plurality of holes. The methods of injection are predetermined by the initial study of the soil in the second step of the method of the invention, and furthermore according to established sequences in accordance with the data which are periodically monitored and finalized in order to modify the chemico-physical characteristics of the lithologies to be consolidated, as set out below.

According to a particular feature of the invention, the monitoring with the tomography of electrical resistivity geologically monitors the behaviour of the soil being examined before, during and after the injection operations so as to end the injection step at the appropriate time, as described below.

In greater detail, during the injection step, and therefore the consolidation step, the monitoring system continues to measure in quasi-real time the variations of the electrical resistivity of the portions of soil involved in the treatment, allowing a continuous and direct comparison in situ, with the preceding readings being carried out and taken as a reference, in order to be able to calculate all the respective variations of the percentage of electrical resistivity.

The data measured are processed using the software loaded in the PC described above. Preferably, in an optional step there are also carried out directly on building sites graphic reconstructions (tomography of the electrical resistivity) in 4D (x,y,z,t) of the volumes of soil in the course of treatment according to the particular characteristics of the time. The graphic reconstruction on building sites is transmitted to the operators directly via images which are also volumetric on the PC so that the developments of the effects induced in the course of work of the injections in the soil are verified in a simple and intuitive manner by comparing the results with the images and the relevant measurements taken beforehand. The dedicated software is capable of extrapolating and graphically displaying the percentage variations of resistivity for each measurement taken at a specific location of the soil but at different times and in such a manner as to recognize any conditions of increase or decrease in the value of resistivity during the injections.

On the basis of the comparisons between the measurements of electrical resistivity carried out at different and sequential times, an operator on the building site is in a position to correct and/or modify in the course of work the parameters of the project of the injection, by evaluating the last measurements carried out and intervening if necessary with subsequent injections which are more considered, acting on the operating parameters of the injection systems, such as: injection elevations, temperature, pressures, times, quantities of products injected, types of products of the injection, degree of any mixing, etc.

Therefore, there is substantially provided an injection step, which may or may not be interrupted, during which the mean electrical resistivity in the volume taken into consideration, or in a portion thereof which is selected, is always monitored. Therefore, preferably according to the invention, there are displayed in the appropriate manner the values of resistivity of the soil and in particular the variation thereof: on the basis of the results measured, there is provision for carrying out the considered injections of the products required, in the measure and in the combinations specifically necessary for obtaining the effects sought which will be distributed geometrically in the soil both in accordance with the injection conditions and with the geolithological conditions of the medium in the consolidation step and which thereby will have to be constantly monitored by ERT means.

The injections (or the injection) will continue in that specific volume of soil which is a portion of the significant volume until the difference between the percentage variation of resistivity obtained in the last measurement carried out (N) and that at the stage carried out previously (N−1), demonstrates a tendency to settle at variations between ±5%, signifying that the consolidation has therefore reached its maximum level of improvement, in terms of the consolidation allowed by that soil.

Figure 1:
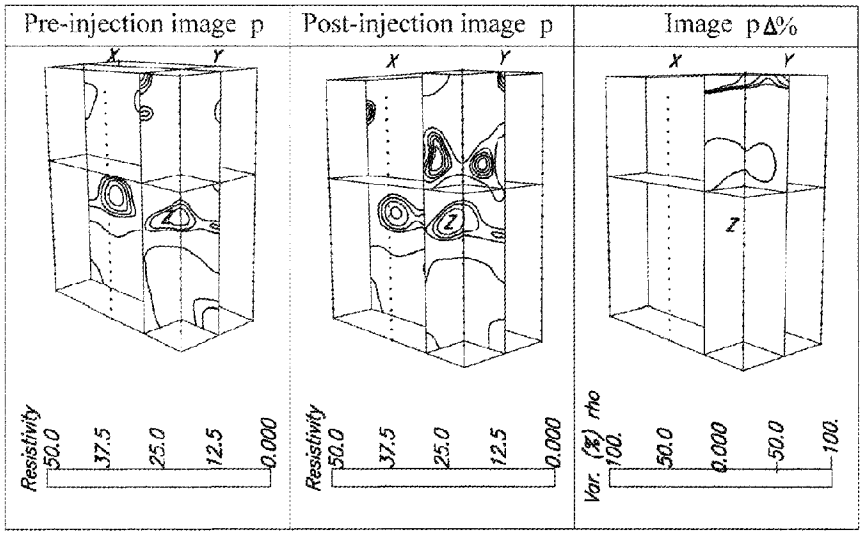
FIGS. 1A, 1B, and 1C show three three-dimensional graphs relating to the electrical resistivity of a volume of soil pre-injection, post-injection, and the difference between the two resistivity values, respectively.
Figure 2:
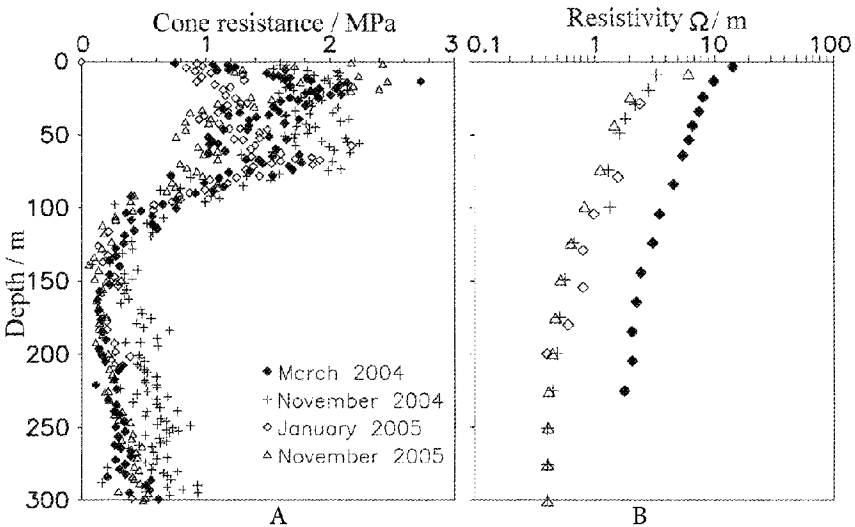
FIGS. 2A and 2B show two graphs representing a local empirical correlation of a site between the course of the electrical resistivity in specific locations of the soil (graph on right) and the cone point resistance penetration of a penetrometer for the same soil locations (graph on left)
Figure 3:
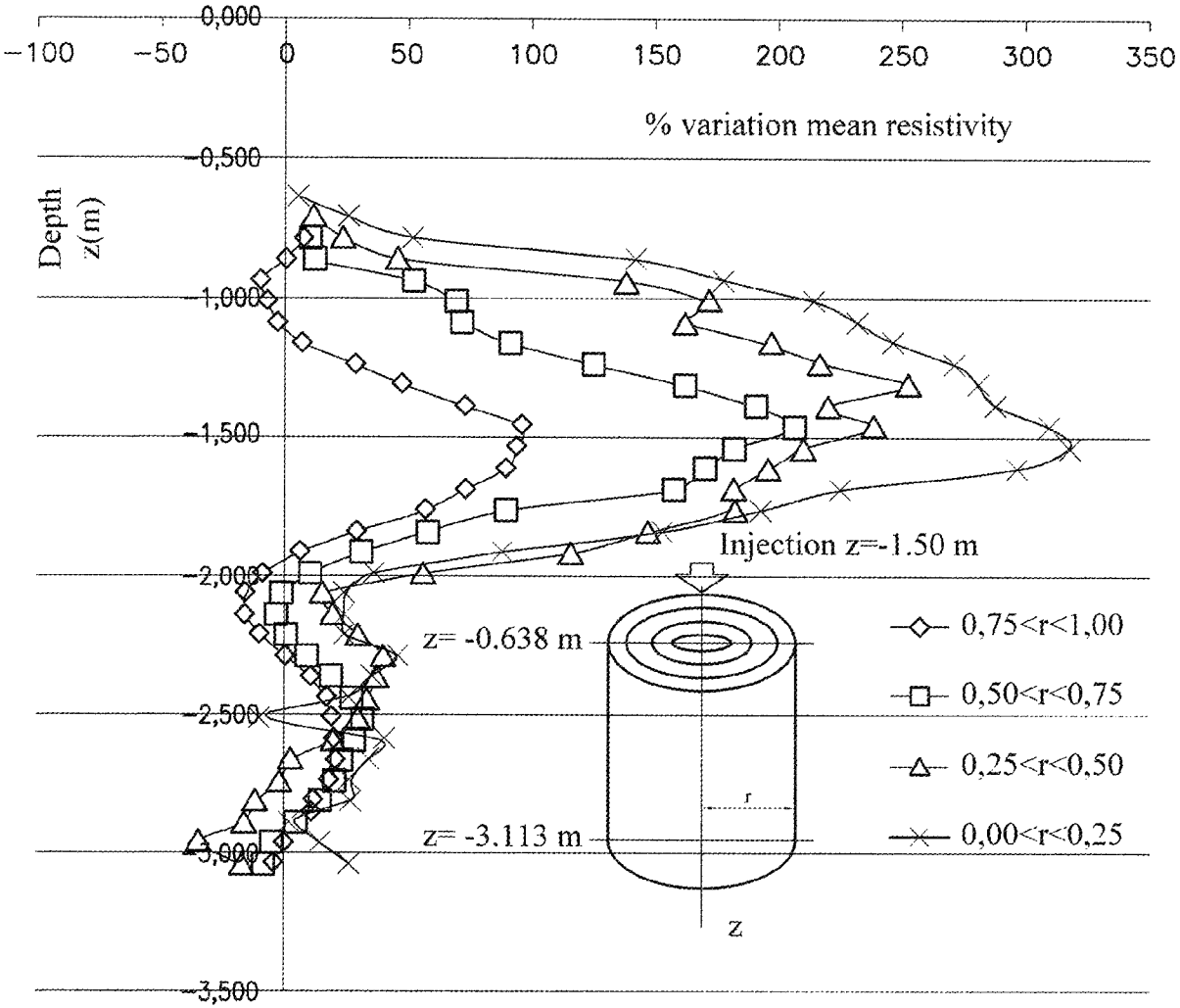
FIG. 3 shows a plurality of lines of the course of the percentage variation of electrical resistivity within a cylindrical volume of consolidated soil with an injection location (X=0, Y=0, Z=−1.5 m)

By way of example, FIG. 3 shows a plurality of lines for showing the progressive development of a consolidation of the soil carried out by means of an injection of expanding resin.

In particular, there have been examined the intermediate stages of percentage variation of resistivity $\Delta\rho(\%)_{mean}$ within a cylindrical volume having a radius r=0.5 m and having an axis of symmetry coincident with that of the two injections which are superimposed on the vertical axis.

In that case, for example, the local result for a cohesive soil, the cylindrical volume having a variable radius (r) and having an axis of symmetry which is coincident with the vertical axis of injection ($Z_{in}$), shows mean percentage variations of electrical resistivity which decrease gradually if consideration is given to locations which are increasingly further away from the axis of injection, demonstrating that the most significant improvements are generally those closest to the injection location ($Z_{in}$=−1.50 m), whilst, conversely, the variation decreases for locations which are increasingly further away.

The invention claimed is:

1. A method of consolidating foundation soils and/or building sites in general, including the steps of:

measuring the electrical resistivity in one or more volumes of the soil to be consolidated to determine the volume(s) of soil to be consolidated;

making one or more holes in the soil as far as or towards the volume(s) to be consolidated;

injecting an expanding resin into the hole(s) in the soil in order to perform a consolidation treatment;

geoelectric monitoring of the injections by progressive measurement of the percentage variations Δρ(%) of mean electrical resistivity of the volume(s) of soil to be consolidated between a state N of the treatment and the immediately preceding state N−1; and interrupting the injections into a particular volume of the soil to be consolidated when the differences in the percentage variations of electrical resistivity $$\left[\left(\frac{\rho_N-\rho_0}{\rho_0}\right)\cdot 100(\%)\right] \text{ and } \left[\left(\frac{\rho_{N-1}-\rho_0}{\rho_0}\right)\cdot 100(\%)\right]$$

measured during the course of work in the soil, between the last state reached N and the immediately preceding state N−1, respectively, satisfy the following equation:

$$\left|\left(\frac{\rho_N-\rho_0}{\rho_0}-\frac{\rho_{N-1}-\rho_0}{\rho_0}\right)\cdot 100(\%)\right| \leq 5\%.$$

2. The method according to claim 1, wherein the step of measuring the resistivity precedes a step of treatment with mathematical algorithms to obtain a tomogram of the electrical resistivity of the soil to be consolidated.

3. The method according to claim 2, wherein the tomogram of the electrical resistivity is three-dimensional.

4. The method according to claim 2, further comprising a step of performing a penetrometric test prior to the injection step in order to define a local site correlation with the electrical resistivity tomogram.

5. The method according claim 1, wherein a gradient of the variations in electrical resistivity is estimated during or after each individual injection or after a group of injections.

6. The method according to claim 1, wherein the geoelectric monitoring step is performed by acquiring data by means of surface transmitter/receiver electrodes and/or depth transmitter/receiver electrodes in the soil, which electrodes are connected to a georesistivity meter.

7. The method according to claim 1, wherein the expanding resin includes closed-cell expanded polyurethane.

8. The method according to claim 1, wherein the injections of the Nth state may be performed either individually or simultaneously into one or more volumes of soil to be consolidated.

9. The method according to claim 1, wherein the injections may be performed at a single depth level or at several levels, in a single solution or delayed solutions alternating with short intermediate pauses.

10. The method according to claim 1, wherein the injections may be performed at superimposed levels, in a single solution or delayed solutions alternating with short intermediate pauses.

* * * * *